US006079169A

United States Patent [19]

Ashworth

[11] Patent Number: 6,079,169

[45] Date of Patent: Jun. 27, 2000

[54] ADJUSTABLE DOOR FRAME

[75] Inventor: William R. Ashworth, Coventry, R.I.

[73] Assignee: Tamer Industries, Inc., Somerset, Mass.

[21] Appl. No.: 09/086,361

[22] Filed: May 28, 1998

[51] Int. Cl.[7] ..... E06B 1/20; E06B 1/12

[52] U.S. Cl. ..... 52/217

[58] Field of Search ..... 52/481.2, 241, 52/217, 212, 213, 126.4, 238.1, 731.9, 126.3, 656.4; 49/504, 505, 468, 469; 403/409.1, 374.1, 314

[56] References Cited

U.S. PATENT DOCUMENTS

| | | | |
|---|---|---|---|
| 2,893,069 | 7/1959 | Kessler | 49/505 X |
| 3,034,609 | 5/1962 | Young | 52/241 |
| 3,553,891 | 1/1971 | Casebolt et al. | 49/505 |
| 3,722,163 | 3/1973 | Satkin et al. | 52/241 X |
| 3,906,671 | 9/1975 | Maldonado | 49/505 |
| 4,156,325 | 5/1979 | McMullen et al. | 49/468 |
| 4,251,962 | 2/1981 | Langenhorst | 52/217 X |
| 5,477,644 | 12/1995 | Chenoweth | 52/217 X |

*Primary Examiner*—Carl D. Friedman
*Assistant Examiner*—Winnie Yip
*Attorney, Agent, or Firm*—Salter & Michaelson

[57] ABSTRACT

A leveling apparatus incorporated in the frame assembly of a sound-proof enclosure for assuring correct alignment of component parts of the enclosure, and a proper plumb fit between the door and door frame during assembly of the enclosure which is assembled on an uneven floor substrate. The leveling device including a leveling block secured within the base of a floor channel, the block having a pair of oppositely disposed tracks which run along a generally inclined plane. A leveling insert is secured within the door frame post and includes a leveling wedge threadably received along an adjustment bolt which runs transversely through the door frame post and the leveling insert for lateral movement of the wedge along the tracks of the leveling block for adjustment of the door frame within the floor channel of the sound-proof enclosure.

3 Claims, 4 Drawing Sheets

ADJUSTABLE DOOR FRAME

BACKGROUND AND SUMMERY OF THE INVENTION

This invention relates generally to leveling apparatus used in connection with structures that have been built on uneven foundations, and more particularly, to an adjustable floor-leveling device incorporated within the framing of a sound-proof enclosure which helps provide correct alignment of component parts during assembly of the enclosure, and which further provides consistent door fits and plumb enclosures that have been assembled on non-level floor substrates.

The floor-leveling device of the instant invention is used in combination with sound-proof enclosures, i.e., booths and protective coverings. Sound-proof enclosures are utilized for different applications in different industries. One particular well-known application for sound-proofing is in the manufacturing industry. Specifically, the enclosures are utilized in the manufacturing plant where there are many loud and noisy assembly machines. In such an environment, it is not uncommon to assemble a sound-proof enclosure around the machines which have high noise output levels. The enclosures provide safer and more desirable work conditions for the workers in the plant as well as providing a protective enclosure for a machine which may have a high monetary value. The enclosure is effective for reducing the noise level of the machine outside of the enclosure, and further blocking access to the machine from persons who do not have permission to gain access to the machine. Generally, such sound-proof enclosures are assembled around the machine and are positioned on top of the floor substrate on which the assembly machine rests. At the base of the enclosure frame is a floor channel which is secured to the floor around the perimeter of the machine. Often times, the floor on which the floor channel is secured is uneven, which presents problems during installation of the enclosure because of misalignment of the component parts of the sound-proof enclosure. Components of the structure become misaligned which leads to troublesome and inadequate assembly.

A prior art device used for leveling sound-proof enclosures constructed on non-level floors consisted of a leveling device incorporated within the frame of the assembly having a screw adjustment head located on the bottom interior surface of the door frame post for manual operation of the device to permit desired adjustment and leveling of the frame post with a screw driver. More specifically, the screw which is vertically oriented, threadedly engages a portion of the frame and bears against a fixed abutment located in the floor channel whereby turning of the screw causes it to act like a jack for raising or lowering the frame. The disadvantage associated with this leveling device is that it is physically difficult to reach and manipulate the screw with a conventional screw driver. The location of the vertically oriented screw makes it difficult to access and adjust, due to its position within the interior of the frame, and lack of leverage that the person adjusting the frame can obtain. Further, the door of the enclosure needs to be open in order for the adjustment to take place since the adjustment locations are on the inner sides of the frame post and can only be accessed if the door is in an open position.

The instant invention is directed to a new and unique leveling device which overcomes the disadvantages associated with the aforesaid prior leveling device. The instant device is effective for leveling a door frame post of any enclosure, such as a sound-proof enclosure that is assembled on a floor having an uneven degree pitch. The leveling device assures correct alignment and a proper plumb fit between the door and door frame post. The device includes a leveling block fixedly secured within the base of a floor channel. The block has spaced tracks or ramps which run along a generally inclined plane. A leveling insert is secured within the interior of a door frame post and includes a leveling wedge threadably received along an adjustment bolt which runs transversely through the frame post and the insert for lateral movement of the wedge along the inclined tracks of the leveling block for adjustment of the door frame post within the floor channel. Specifically, rotation of the adjustment bolt in a clockwise direction causes the leveling wedge to ride up the inclined tracks of the leveling block, which in turn raises the door frame post, and rotation of the bolt in a counter-clockwise direction lowers the wedge along the tracks, which adjusts the door frame post to a lower position.

Accordingly, among the several objects of the instant invention are: the provision of a floor-leveling device for adjustment of a door frame post assembled on a floor having an uneven degree pitch; the provision of such a floor-leveling device that assures a plumb fit between the door and the door frame; the provision of such a floor-leveling device that adjusts to other components of the enclosure to assure proper alignment during assembly of a sound-proof enclosure; the provision of a floor-leveling device that is easy to access and manipulate; and the provision of a floor-leveling device that is cost efficient and easy to manufacture.

Other objects, features, and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENTS

Figure 1:
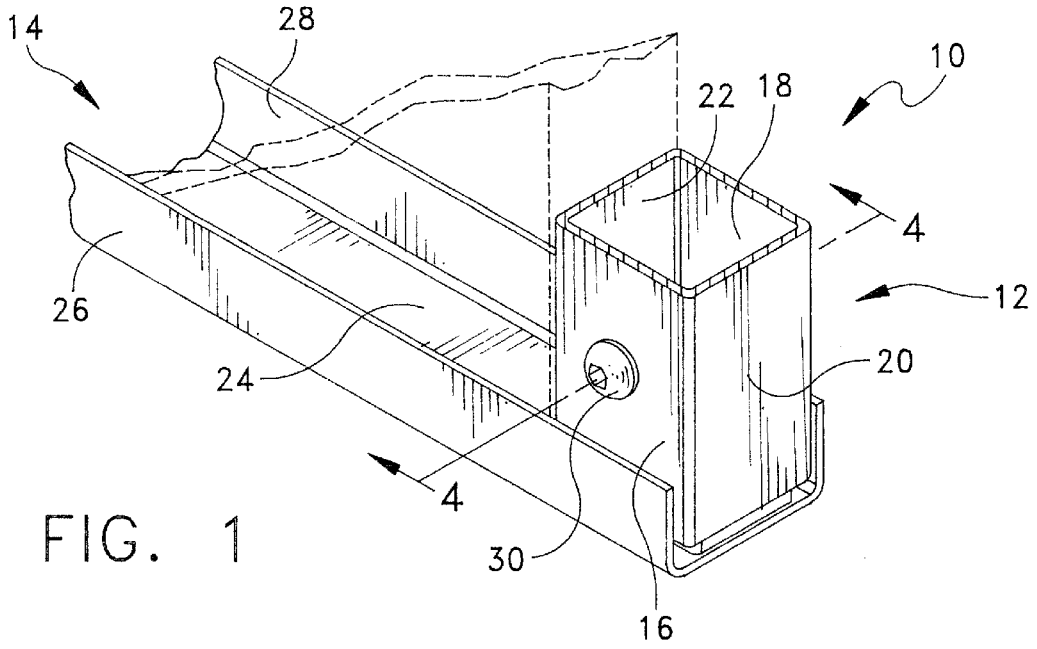
FIG. 1 is a fragmentary perspective view of the adjustable floor-leveling frame of the instant invention.

Referring now to the drawings, and more particularly to FIG. 1, a portion of a frame assembly including the frame leveling device of the instant invention is shown and generally indicated at 10. As will hereinafter be more fully described, the frame leveling assembly of the instant invention is effective for raising or lowering a door frame to compensate for a non-level floor. The frame leveling assembly is particularly effective with sound-proof enclosures whereby the assembly is concealed within a bottom corner of the door frame post and is easily accessible from the exterior of the enclosure. The frame leveling assembly helps to provide a plumb fit between the door and door frame of the enclosure, which often times, become misaligned if the floor on which the sound-proof enclosure is assembled is not completely level.

Referring to FIG. 1, the bottom portion of a door frame post generally indicated at 12 is received within a floor channel generally indicated 14. The framing post 12 has two pairs of oppositely positioned walls which meet at edges to define a generally elongate rectangular shape having a hollow interior. Specifically, a front wall is indicated at 16, a back wall at 18, and two side walls indicated at 20 and 22. The floor channel 14 includes a substantially flat base plate 24 having a pair of oppositely disposed upwardly extending retaining walls 26 and 28 which define the channel 14 in which the frame posts 12 of the structure are received. The frame leveling assembly 10 of the instant invention is used in combination with a sound-proof enclosure, but it should be understood that the leveling assembly of the instant invention may be used in combination with any number of different assembly enclosures that are constructed on uneven floor substrates and require adjustment to assure proper alignment of parts and adequate assembly. The first step in assembling the sound-proof enclosure is to fixedly secure the floor channel 14, which defines the perimeter of the enclosure, to a floor substrate (not shown), typically by screws (not shown), in the location where the enclosing structure is to be assembled. The post and beam assembly of the enclosure is rooted within the floor channel 14 and the remaining parts of the enclosure are assembled in accordance with the specifications for the particular structure assembly. As depicted, the door frame post 12 is received within the floor channel 14, preferably at one of the four corners of the enclosure, typically the front right hand corner, if one were facing the front side of the enclosure. A hex head 30 is located at the exterior of the front wall 16 of the frame post 12 and is operable for rotation of an adjustment bolt 32 which runs transversely through the door frame post 12. The head 30 is spaced upwardly from the top edge of retaining wall 26 so that it may be easily accessed for operation of the leveling device, which will be described in greater detail as the description of the invention proceeds.

Figure 2:
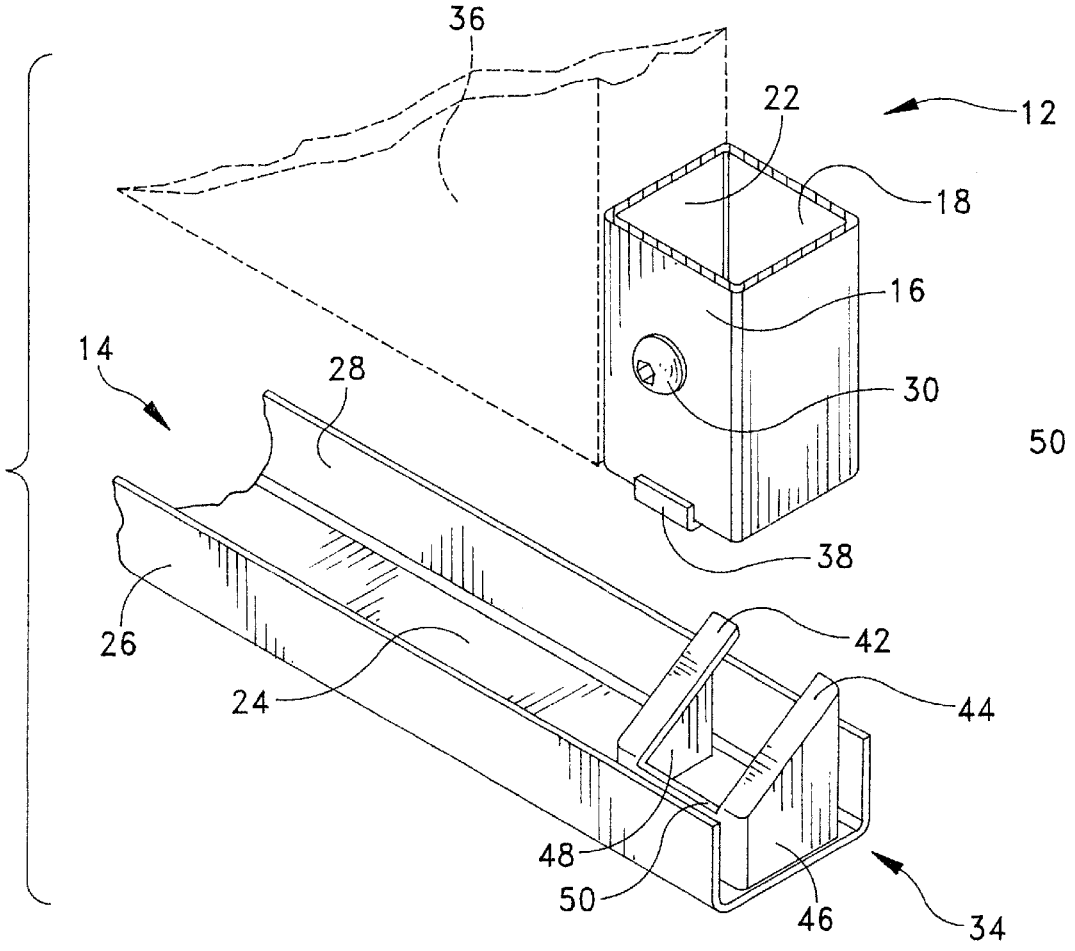
FIG. 2 is a fragmentary exploded perspective view showing the floor channel and the adjustable frame leveler of the instant invention.

Referring now to FIG. 2, the door frame post 12 is shown removed from the floor channel 14 revealing a leveling block, generally indicated at 34, fixedly secured to the base 24 of the floor channel 14. Also illustrated in FIGS. 1 & 2, broken away, is a portion of a wall 36 which is illustrated in broken lines. The door frame post 12 is received within the floor channel 14, as shown in FIG. 1, and retained therein by friction tabs 38 and 40, shown in FIG. 2, which engage the interior surface of retaining walls 26 and 28 to releasably maintain the frame post 12 within the floor channel 14. The leveling block 34 is fixedly secured within the floor channel 14 at the corner of the enclosure in which the door frame post 12 and wall assembly 36 are fitted. The leveling block 34 is preferably soldered to the base 24 of the floor channel 14 and has a pair of oppositely positioned track members 42 and 44 which run along a generally inclined parallel plane which in combination with other components of the leveling device enable the frame post 12 to be either raised or lowered within the floor channel 14 to provide a level foundation for correct alignment of parts during assembly of the structure. The leveling block 34 further includes a pair of oppositely positioned side walls 46 and 48 which extend upwardly from the base 24 of the floor channel 14 and a front wall 50 which bridges the side walls 46 and 48 of the block 34. The tracks 42 and 44 actually are the top edges of side walls 46 and 48, and define inclined parallel flat surfaces.

Figure 3:
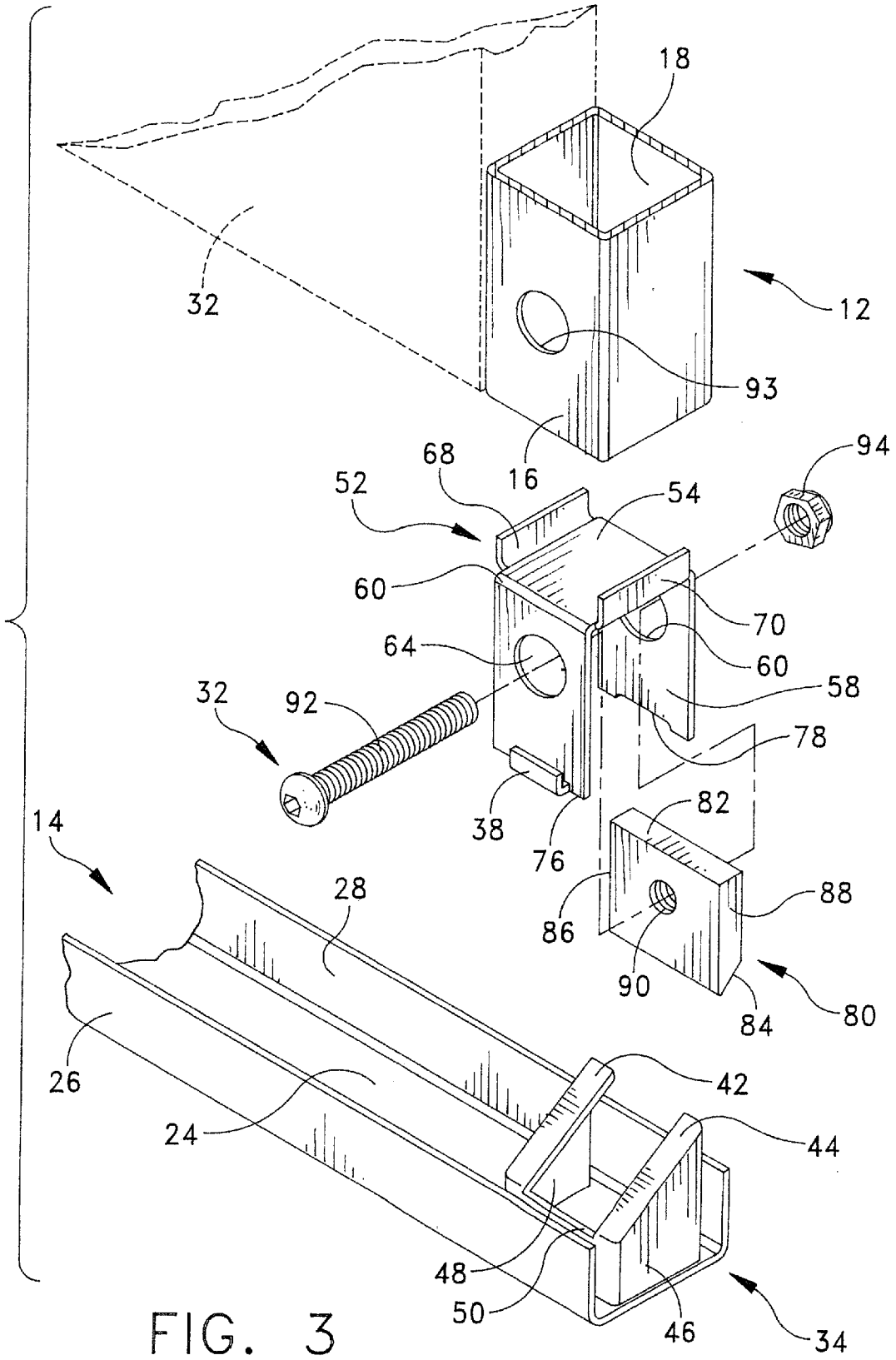
FIG. 3 is an exploded perspective view showing the components of the adjustable frame leveler of the instant invention.

Referring now to FIG. 3, all of the components which make up the frame leveling assembly of the instant invention 10 are shown and more easily identified. First, a leveling insert is shown and generally indicated at 52. The insert includes a horizontal plate 54 having a pair of tongues 56 and 58 which extend downwardly from oppositely positioned side edges 60 and 62 of the plate, each tongue 56 and 58 having an aligned opening 64 and 66 formed therein for receiving the adjustment bolt 32 which runs transversely therethrough for securing the insert 52 within the interior of the door frame post 12. A pair of arms 68 and 70 extend upwardly from oppositely positioned side edges 72 and 74 of the horizontal plate 54 and friction tabs 38 and 40 extend upwardly from the bottom edges 76 and 78 of oppositely positioned tongues 56 and 58 for frictionally gripping the front wall 16 and the back wall 18 of the frame post 12 for more securely retaining the insert 52 within the door frame post 12. A leveling wedge, generally indicated at 80, has a substantially flat top edge 82, a slanted bottom edge 84, and opposing flat side edges 86 and 88. The wedge 80 is received between tongues 56 and 58 and has a centrally located threaded bore 90 formed therein for threadedly receiving the shaft 92 of the adjustment bolt 32 and retaining the wedge 80 between the tongues 56 and 58 of the insert 52. The shaft 92 of the adjustment bolt 32 runs transversely through aligned openings 93, formed in walls 16 and 18 of the frame post, through aligned openings 64 and 66 of tongues 56 and 58 of the insert 52, and through bore 90 of the leveling wedge 80 of the assembly for fixedly securing the leveling insert 52 and leveling wedge 80 within the hollow interior of the frame post 12. A nut 94 is threadably received at the other end of the shaft 92 of the adjustment bolt 32 for releasably securing the leveling insert 52 and leveling wedge 80 within the interior of the frame post 12.

Figure 4:
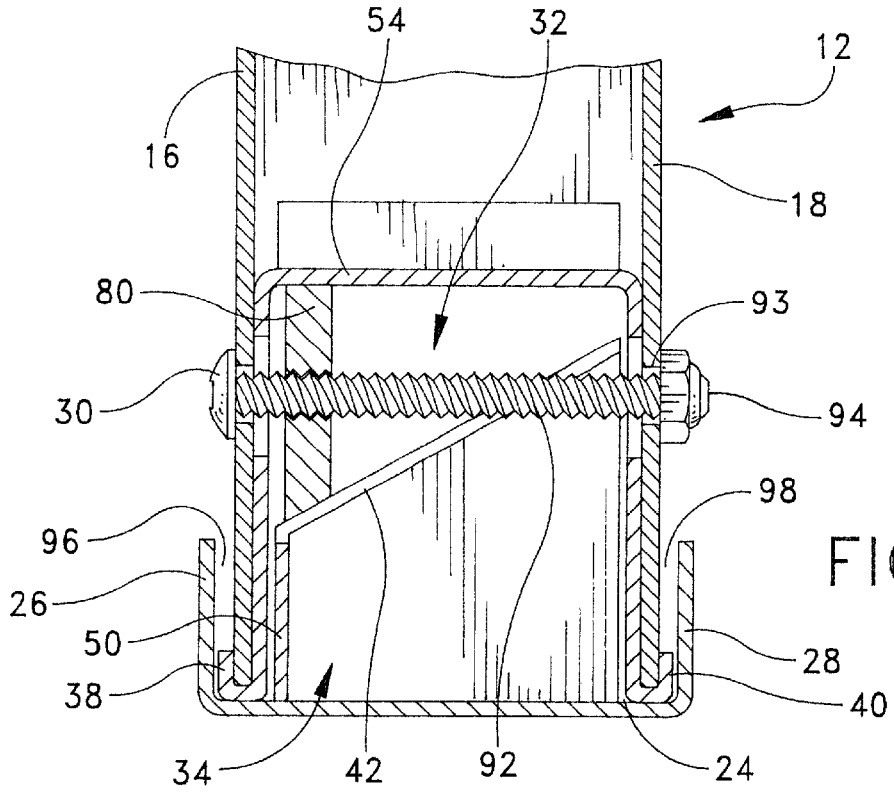
FIG. 4 is a cross-section taken along line 4—4 of FIG. 1 showing the door frame in a lowered position.
Figure 5:
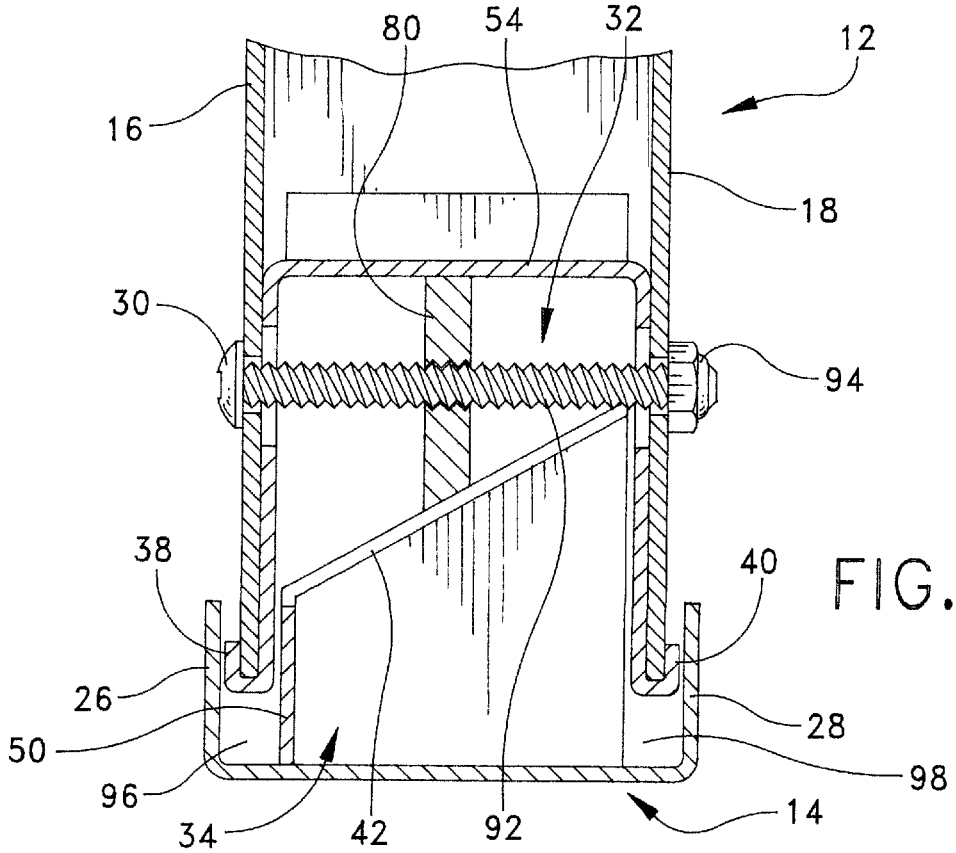
FIG. 5 is a cross-sectional view similar to that shown in FIG. 4 illustrating the door frame in a half-raised position.
Figure 6:
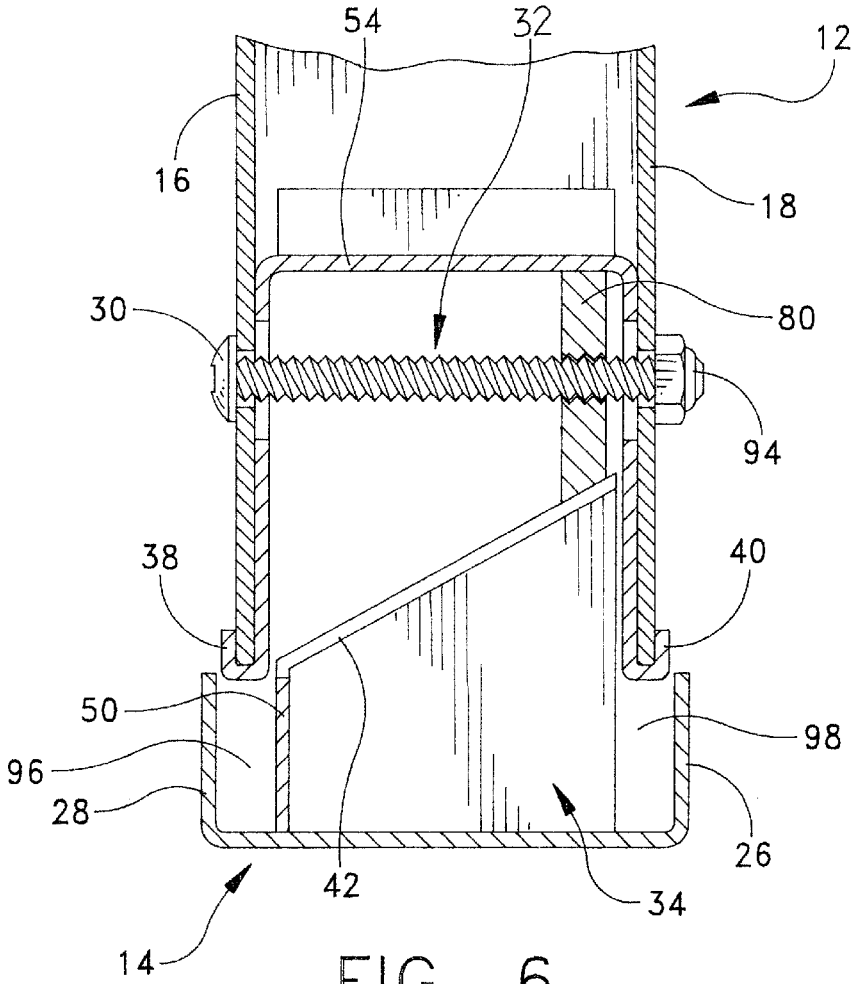
FIG. 6 is a cross-sectional view similar to that shown in FIG. 5 illustrating the door frame in a fully raised position.

Referring now to FIGS. 4–6, the frame leveling assembly of the instant invention 10 is depicted at three different adjustable positions. First, referring to FIG. 4, the door frame post 12 is shown at its natural lowest position resting against the base 24 of the floor channel 14. FIG. 5 shows the frame post 12 raised half-way up the retaining walls 26 and 28 of the floor channel 14, and FIG. 6 shows the frame post raised to the maximum at the top of the retaining walls 26 and 28 within the floor channel 14. As best shown in FIGS. 4–6, there are a pair of gaps 96 and 98 formed between the leveling block 34 and the retaining walls 26 and 28 of the floor channel 14. Specifically, gap 96 is formed between the front wall 50 of the leveling block 34 and retaining wall 26, and the second equally spaced gap 98 is formed between the back edges of the side walls 46 and 48 of the leveling block 34 and retaining wall 28. The gaps 96 and 98 are sized to snugly receive the front wall 16 and back wall 18 of the framing post 12, whereby friction tabs 38 and 40 engage the interior surface of retaining walls 26 and 28 to maintain the framing post 12 snugly within the floor channel 14.

FIG. 4 depicts the leveling device 10 at the lowest position, wherein the leveling wedge 80 is positioned at the bottom of the tracks 42 and 44 of the leveling block 34. FIG. 5 depicts the leveling wedge 80 of the device 10 positioned half-way up the tracks 42 and 44 of the leveling block 34. Specifically, rotation of the hex head 30 located at the exterior of the front wall 16 of the frame post 12 rides the leveling wedge 80 along the shaft 92 of the adjustment bolt 32 and up the tracks 42 and 44 of the leveling block 34. The top edge 82 of the wedge 80 engages the bottom surface of the horizontal plate 54 of the leveling insert 52 and the slanted bottom edge 84 of the wedge 80 engages tracks 42 and 44 of the leveling block 34 to force the frame post 12 upwardly within the floor channel 12 of the enclosure to the desired level position. FIG. 6 depicts the leveling wedge 80 at the top of the tracks 42 and 44 of the leveling block 34 forcing the door frame post 12 to its highest position within the floor channel 14 of the enclosure.

Figure 7:
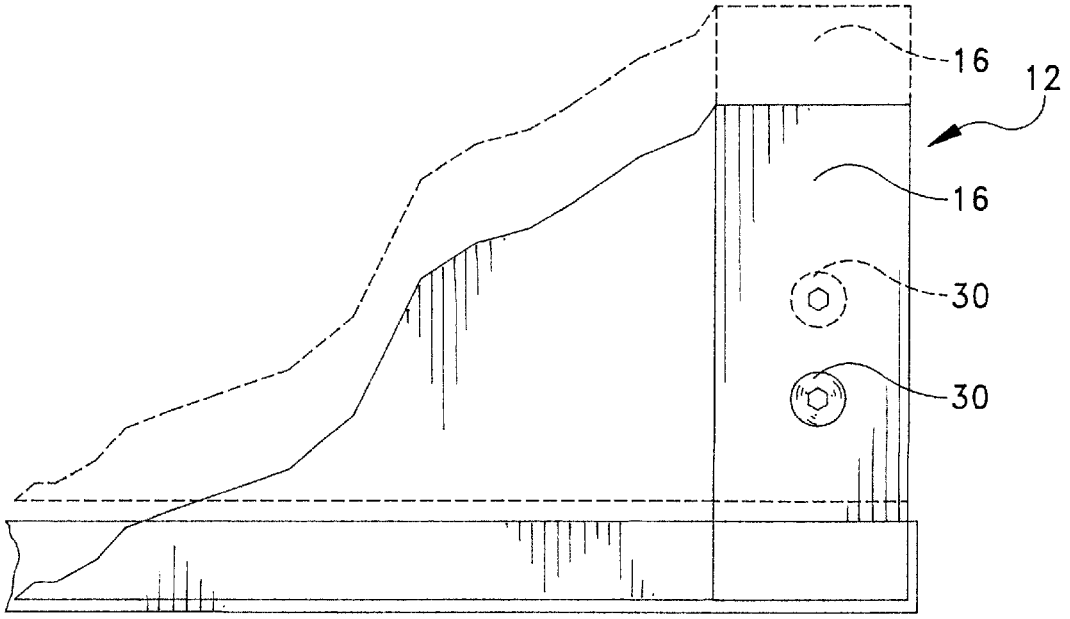
FIG. 7 is a fragmentary front view showing a lower corner of the adjustable floor-leveling frame in its lowermost position (full lines), and its uppermost position (broken lines).

Referring to FIG. 7, the leveling device of the instant invention 10 is concealed within the door frame post 12 of an assembled sound-proof enclosure. Located at the exterior of the front wall 16 of the frame post 12, is the hex adjustment head 30, which is easily accessible and operable with a suitable sized Allen wrench for either raising or lowering the frame post 12, in the manner described above, to the desired level position within the floor channel 12. In use, rotation of the adjustment head 30 in either a clockwise or counterclockwise direction, respectively, raises or lowers the leveling wedge 80 up and down the tracks 42 and 44 of the leveling block 34. Specifically, the slanted bottom edge 84 of the leveling wedge 80 engages against the top surface of the tracks 42 and 44 of the leveling block 34, and the flat top edge 82 of the leveling wedge 80 engages against the bottom surface of horizontal plate 54 of the leveling insert 52. The arrangement is such that rotation of the hex head 30 in a clockwise direction rides the leveling wedge 80 laterally along the shaft 92 of the adjustment bolt 32 and up the tracks 42 and 44 of the leveling block 34 which forces the leveling insert 52 upwardly, and in turn, raises the door frame post 12 to the desired level position within the floor channel 14. Conversely, rotation of the hex head 30 in a counterclockwise direction rides the leveling wedge 80 in an opposite direction along the shaft 92 of the adjustment bolt 32, which lowers the leveling insert 52 and the door frame post 12 to the desired level position within the floor channel 12. It will be understood that the door itself, not shown, is hingedly attached to post 12, and specifically, surface 20 thereof, so that as the post moves up and down, the door moves correspondingly therewith, whereby the bottom of the door can be adjusted to conform to the substrate on which the door is mounted.

It can therefore be seen that the instant invention provides an effective floor-leveling device for adjustment of a frame assembly that is constructed on an uneven floor substrate. The floor leveling device is easy to access and manipulate, which allows for proper adjustment in a more time efficient manner. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept, and that the same is not limited to the particular forms herein shown and described except insofar as indicated by the scope of the appended claims.

What is claimed is:

1. Adjustable door frame leveler apparatus for mounting doors on an uneven floor substrates, said apparatus comprising:

a floor channel having a base and a pair of oppositely disposed upwardly extending retaining walls;

a leveling block secured within said channel, said block having an upwardly disposed inclined track including a pair of spaced walls having flat, inclined, coplanar top edges;

a hollow door frame surrounding said block and extending upwardly from said channel and vertically movable with respect to said channel;

a hollow leveling insert securely mounted within said frame;

a threaded adjustment bolt extending across said insert and rotatable with respect to said insert; and a leveling wedge in threaded engagement with said bolt, said wedge having an inclined surface in mating engagement with said inclined track whereby rotation of said bolt in one direction causes said wedge to ride up said track to raise said frame, while rotation of said bolt in the opposite direction causes said wedge to ride down said track to lower said frame.

2. In the apparatus of claim 1, said leveling block being positioned in said channel in spaced relation to said upwardly extending walls so as to define gaps therebetween, said gaps providing spaces for snugly receiving the lower ends of said door frame and said leveling insert.

3. The apparatus of claim 1 in combination with an assembly enclosure.

* * * * *